US012303749B2

(12) United States Patent
Stadler

(10) Patent No.: US 12,303,749 B2
(45) Date of Patent: May 20, 2025

(54) GOLF CLUB HEAD AND GOLF CLUB

(71) Applicant: GOLFYR AG, Niederteufen (CH)

(72) Inventor: Roger Stadler, Niederteufen (CH)

(73) Assignee: GOLFYR AG, Niederteufen (CH)

( * ) Notice: Subject to any disclaimer, the term of this patent is extended or adjusted under 35 U.S.C. 154(b) by 273 days.

(21) Appl. No.: 17/595,810

(22) PCT Filed: May 26, 2020

(86) PCT No.: PCT/EP2020/064583

§ 371 (c)(1),
(2) Date: Nov. 24, 2021

(87) PCT Pub. No.: WO2020/239769

PCT Pub. Date: Dec. 3, 2020

(65) Prior Publication Data

US 2022/0226698 A1 Jul. 21, 2022

(30) Foreign Application Priority Data

May 27, 2019 (EP) ..... 19176763

(51) Int. Cl.
*A63B 53/04* (2015.01)
*A63B 60/46* (2015.01)
*A63B 60/54* (2015.01)

(52) U.S. Cl.
CPC ..... *A63B 53/042* (2020.08); *A63B 53/0466* (2013.01); *A63B 60/46* (2015.10); (Continued)

(58) Field of Classification Search
CPC ... A63B 53/042; A63B 53/0466; A63B 60/46; A63B 60/54; A63B 2053/0491; (Continued)

(56) References Cited

U.S. PATENT DOCUMENTS 4,984,800 A * 1/1991 Hamada ..... A63B 60/00 264/250
5,193,811 A 3/1993 Okumoto et al.
(Continued)

FOREIGN PATENT DOCUMENTS

DE 101 03 449 A1 8/2002
FR 2 689 407 A1 10/1993
(Continued)

OTHER PUBLICATIONS

International Search Report for PCT/EP2020/064583 dated, Jul. 27, 2020 (PCT/ISA/210).

*Primary Examiner* — Nini F Legesse
(74) *Attorney, Agent, or Firm* — Sughrue Mion, PLLC

(57) ABSTRACT

Provided is a club head (1) for a golf club, comprising an impact plate (4) for teeing off a golf ball. The club head also includes a shell (2) produced from a first material, on which the impact plate (4) is attached, a core (3) at least partially surrounded by the shell (2) and produced from a second material, and at least one weighting element (6; 6*a*. 6*b*) produced from a third material. The second material of the core (3) has a lower density than the first material of the shell (2). The third material of the weighting element (6; 6*a*. 6*b*) has a higher density than the first material of the shell (2) and/or than the second material of the core (3). Additionally, at least one sensor unit (5) is also provided, winch is arranged at least partially inside the core (3).

14 Claims, 10 Drawing Sheets

(52) U.S. Cl.
CPC ..... *A63B 60/54* (2015.10); *A63B 2053/0491* (2013.01); *A63B 2209/02* (2013.01); *A63B 2220/34* (2013.01); *A63B 2220/40* (2013.01); *A63B 2220/833* (2013.01); *A63B 2225/54* (2013.01)

(58) Field of Classification Search
CPC ..... A63B 2209/02; A63B 2220/34; A63B 2220/40; A63B 2220/833; A63B 2225/54; A63B 53/04; A63B 2209/00
USPC ..... 473/324–350, 287–292
See application file for complete search history.

(56) References Cited

U.S. PATENT DOCUMENTS 5,570,886 A * 11/1996 Rigal ..... A63B 53/04 473/335
5,947,840 A 9/1999 Ryan
6,860,818 B2 * 3/2005 Mahaffey ..... A63B 60/02 473/256
7,455,600 B2 * 11/2008 Imamoto ..... A63B 53/0466 473/335
9,333,390 B1 5/2016 Manwaring et al.
10,213,665 B1 2/2019 Day et al.
2005/0233831 A1 * 10/2005 Ezaki ..... A63B 60/02 473/345
2010/0093458 A1 4/2010 Davenport et al.
2013/0085012 A1 4/2013 Boyd et al.
2013/0184099 A1 * 7/2013 Stites ..... A63B 69/3685 473/335
2014/0349777 A1 11/2014 Beno et al.
2015/0045130 A1 2/2015 Roach
2017/0232309 A1 8/2017 Dolezel et al.

FOREIGN PATENT DOCUMENTS

JP 4-2375 A 1/1992
JP 2002-126140 A 5/2002
JP 2017-140385 A 8/2017
WO WO-9319817 A1 * 10/1993 ..... A63B 53/04
WO 2005/118086 A1 12/2005
WO 2006/124091 A2 11/2006
WO 2009/118019 A1 10/2009

* cited by examiner

GOLF CLUB HEAD AND GOLF CLUB

CROSS REFERENCE TO RELATED APPLICATIONS

This application is a National Stage of International Application No. PCT/EP2020/064583 filed May 26, 2020, claiming priority based on European Patent Application No. 19 176 763.1 filed May 27, 2019.

TECHNICAL FIELD

The present invention relates to a club head for a golf club and to a golf club with such a club head.

STATE OF THE ART

Golf is a widespread sport in which both the performance of the golfer and the technological characteristics of the golf club are of central importance From a technological point of view, it is important that the golf ball can be hit into the vicinity of the hole in as controlled and targeted a manner as possible from a wide variety of environmental situations. In the field of golf club development and construction, one goal is therefore to improve both the directional accuracy and the achievable distance of the shots.

In addition to these purely technological demands on the golf club, the playing skills of the golfer are of decisive importance. Thus, there is a great need to offer the golfer possibilities to improve his performance. In order for a golfer to improve his playing skills, he must be able to understand his playing deficiencies. Measurement and analysis devices that enable the most accurate possible recording and analysis of a golfer's game can substantially assist the golfer in his training.

For example, WO 2009/118019 discloses a measuring device for attaching to a golf club in order to transmit data relating to the accuracy of impact and the swing movement wirelessly to a mobile evaluation device, such as for example a mobile phone, smartphone or PDA, by means of the measuring device. On the one hand, the hitting accuracy is measured on a sensor plate mounted on the striking surface of the club head, as well as the direction of rotation, angular velocity, angular position and duration of the phases of the backswing and forward swing movements of the club head.

DE 101 03 449 describes a golf club with a measuring device arranged on the club head for measuring the speed and/or the speed profile of the club head. The maximum speed or the speed profile during the stroke delivery is displayed on a display device attached to the golf club.

Other technical possibilities for recording or analysing the individual golf swing, which are mounted in the club head itself, are known, for example, from US 2010/0093458, wherein physical parameters such as the acceleration movement or impact forces are measured directly by sensors in the club head and used for a golf swing analysis. For this purpose, the club face can have an outer metal layer and an inner metal layer, with pressure sensors arranged in between.

A detection of the golf swing movements by a sensor module, which is integrated in the club head or mounted on the club head, is known from WO 2005/118086. The sensor module has a gyro sensor and acceleration sensors.

Golf clubs, golf equipment in general, and all training accessories are often very expensive, especially due to the high technological requirements. Thus, another need of the golfer is to be able to protect his equipment against potential theft. At the same time, it is also in his interest that he does not acquire counterfeit equipment but unadulterated equipment which also meets his quality requirements, in particular his technological requirements.

WO 2006/124091 discloses an HF tag or RFD tag which is attached to the grip of a golf club. A device transmits a signal to the tag at regular intervals. As long as the tag is within a certain distance of the device, a feedback signal is sent from the tag to the device. If the tag is outside the specified distance, a notification is sent from the device to the golfer.

In golf, the golf ball is often hit with a very high force by the club head. It is known that as a consequence of this, analogous to the game of tennis, the bouncing or swinging of the golf club during or after the impact on the ball can lead to a so-called "tennis elbow". In addition to this health aspect, the bouncing or swinging of the golf club also influences the stroke, the immediate tee shot, and thus the entire movement and stroke profile, and therefore also has a significant influence on the golfer's performance. In addition, impact energy is also lost through the backstroke and the swing of the golf club, which should be utilised for ball acceleration. Any measuring or analysis devices attached to the golf club are also affected by this bouncing or swinging, whereby, depending on the extent of the bouncing or swinging, inaccurate measuring or analysis results may result.

Due to the high impact energy, there is also a risk of damage to the sensor unit. The risk of such damage can possibly be reduced by a more robust design of the sensor unit. However, this usually increases the weight of the golf club, which can result in an unintentional change in the stroke behaviour. This can also increase the bouncing or swinging of the golf club and thus the risk of the tennis elbow mentioned further above.

Since the largest swing movement of a golf club is carried out by the club head from the outswing to the moment of the tee shot, measuring or analysis devices provided on the club head are very suitable for recording the club movement of a golfer as completely as possible. However, since it is the club head that is most exposed to the great force of the tee shot, the provision of the measuring or analysis devices on the club head is associated with certain disadvantages and/or risks, for example due to the aforementioned bouncing or swinging. For example, the bouncing or swinging may have an unwanted influence on the measurement or analysis results. In addition, measuring or analysis devices have a weight of their own, which can also lead to undesirable changes in the swinging behaviour.

SUMMARY OF THE INVENTION

It is an object of the invention to provide a club head for a golf club which has an improved hitting behaviour.

In order to achieve this object, a club head for a golf club is provided which comprises a striking plate for striking a golf ball. The club head comprises a shell made of a first material, to which the striking plate is attached, a core made of a second material and at least partially surrounded by the shell, and at least one weighting element made of a third material. The second material of the core has a lower density than the first material of the shell. Furthermore, the third material of the weighting element has a higher density than the first material of the shell and/or than the second material of the core.

The different densities of the core and shell material allow the production of a club head with a particularly low weight, which also has good bounce and backstroke damping. By means of the weighting element, the weight distribution of the club head can be optimised with regard to its impact behaviour, and/or the weighting element can be used to achieve any predetermined weight specifications. In particular, the weighting element(s) can be arranged at precisely defined and preferably previously calculated positions in the club head in order to achieve optimum impact behaviour. By increasing the moment of inertia of the club head and/or changing its centre of gravity by means of the at least one weighting element, for example, a high directional accuracy and long hitting distances can be achieved.

Due to the bounce and backstroke damping, an ergonomic handling as well as an increased ball acceleration due to a better utilisation of the impact energy as well as a lower dispersion of the trajectory can be made possible. In addition, this can also protect the golfer in terms of ergonomic handling and enable precise stroke control. The club head as indicated thus has by a particularly good impact behaviour.

In particular, it is possible that the second material of the core is softer and/or more elastic than the first material of the shell.

The shell may be partially surrounded by the striking plate. The shell may partially enclose or completely enclose the core. Advantageously, however, the shell encloses at least a major portion of the core.

Preferably, the striking plate is attached directly to the outside of the shell and in particular rests directly on it. The striking plate is usually made of a relatively hard material, which is in particular harder than the material of the core and the shell. For example, the striking plate may be made of a metal, such as iron in particular.

It is preferred that the core occupies a larger volume of the club head than the shell. However, it is also conceivable that the club head and the shell have a similarly large volume, which may be the case, for example, with a thin, filigree club head.

The first material of the shell may be a composite material, such as in particular a fibre-reinforced plastic, Composite material is understood here to be a composite material consisting of two or more joined materials that have different properties than the respective individual components. Basically, a composite material consists of a base material, which is referred to as a matrix, and a reinforcing material, such as a fibre. Exemplary materials for a matrix material include thermoplastic materials such as polyetheretherketone (PEEK), thermoset materials such as resins, etc. Examples of fibres include materials such as carbon fibres, glass fibres, aramid, Kevlar fibres, etc. In this regard, a large number of suitable composite materials for a club head are known to the skilled person.

However, the shell of the club head may also comprise other materials, for example steel, amorphous metals, ceramics, carbon, carbon fibres and other fibre materials.

As mentioned above, the second material of the core has a lower density than the density of the first material of the shell. Thus, the second material of the core may be a foam material. By a foam material is meant hem a material which is usually man-made and has a cell-like structure with a low density. Materials suitable for foaming and for the present application are, for example, many plastics in the sense of organic, polymeric solids such as thermoplastics, thermosets or elastomers, which can reduce their volume under pressure, i.e. exhibit compressibility.

The second material of the core can also be a gaseous material, such as air in particular. In this case, the shell encloses a cavity and the gaseous material filling this cavity forms the core. The core thus has a particularly low weight. Surprisingly, with club heads whose core is foamed or gaseous, a particularly advantageous impact behaviour could be observed in each case.

In a particularly preferred embodiment, the club head additionally has at least one sensor unit which is at least partially arranged inside the core.

By being at least partially arranged inside the core, the at least one sensor unit is well protected and has a minimal influence on the hitting behaviour. The sensor unit is thus at least partially surrounded by the second material of the core, but preferably it is even completely arranged inside the core, i.e. completely surrounded by the second material of the core. Advantageously, at least a major part of the sensor unit is arranged inside the core.

The lower density as well as a preferably existing compressibility of the core lead to a damping or weakening of the bouncing or swinging, triggered by the great impact of the tee stroke, and thereby protect on the one hand the sensor unit from these unwanted forces. On the other hand, by damping the impact energies acting on the sensor unit, an accurate measurement and analysis of the impact dynamics is also made possible.

It is conceivable that the sensor unit has, for example, a signal transmitter and/or an electronic unit or signal evaluation unit, whereby the signal transmitter rests on the striking plate and the electronic unit or signal evaluation unit is arranged at least partially in the interior of the core. Preferably, a predominant volume portion of the sensor unit and in particular of the electronic unit belonging to the sensor unit is ranged in the interior of the core.

Due to the low density of the second material of the core, in which the at least one sensor unit is arranged, there is a damping of the tee forces on the sensor unit that occur when the golf ball is hit, which enables precise detection and/or analysis of the club movement during the outswing and the tee swing.

The core may partially enclose or completely enclose the sensor unit. Preferably, however, the sensor unit is at least completely enclosed by the shell.

The sensor unit may comprise at least one sensor for detecting the impact dynamics. The sensor for detecting the impact dynamics may be an angular velocity sensor and/or an acceleration sensor and/or a magnetic sensor. It can also be a sensor for measuring the accuracy of impact, which is attached to the striking, plate of the golf club, for example. It is conceivable that the sensor unit comprises two or more sensors for detecting the impact dynamics, and that then, for example, one such sensor is an angular velocity sensor and another sensor is an acceleration sensor or a magnetic sensor.

The sensor unit may comprise at least one sensor for ensuring anti-counterfeiting. In this case, the sensor for ensuring anti-counterfeiting may be designed as an RFID transponder suitable for transmitting and/or receiving RF signals. It is also conceivable that the sensor unit has two or more sensors to ensure protection against anti-counterfeiting.

RFID refers to "radio-frequency identification", a generally known technology for transmitter-receiver systems for contactless identification or localisation of objects by means of radio waves. An RFID system usually consists of a transponder, which is located on or in the object and contains an identifier, and a suitable reader for reading this identifier.

For example, the sensor unit may comprise one or more sensors to detect the impact dynamics, or one or more sensors to ensure anti-counterfeiting. However, the sensor unit may also comprise one or more sensors for detecting the impact dynamics, and one or more sensors for ensuring anti-counterfeiting. In other words, it may be said that the sensor unit may comprise any number of sensors for detecting the impact dynamics and/or for ensuring anti-counterfeiting.

The sensor unit may also comprise one or more sensors in the form of one or more chips, such as in particular RFID transponders.

Alternatively or additionally, the sensor unit may comprise a location sensor, in, particular a Global Positioning System (GPS) sensor, to detect the swing and/or the location of the hitter. The location sensor can be combined in particular with another sensor, for example arranged in the shaft or in the grip of the golf club, in order to determine the position of the club or the club head. A tilt sensor may also be provided in the club head, shaft or grip.

The signals detected by the sensor unit can be transmitted to a signal evaluation unit. For example, the at least one sensor for detecting the stroke dynamics can detect the club movement during the swing, and the tee swing by an acceleration sensor measuring the acceleration or an angular velocity sensor measuring the position of the club head. These measurement parameters—or data—can be transmitted to an analysis device such as a handheld device, e.g. a mobile phone or an iPad, e.g. by means of wire, Bluetooth or WLan. On the handheld device, for example, the stroke consistency or the stroke accuracy can be evaluated in order to support the users learning process. Similarly, a transmission or evaluation of security information can be carried out by means of the at least one sensor or chip to ensure counterfeit protection, for example by using a reader that generates a high-frequency electromagnetic alternating field to which the RFID transponder is exposed and thereby activated. The RFID transponder activated in this way, preferably in the form of an activated microchip in the RFID tag, influences the electromagnetic transmission field of the reader and thus allows conclusions to be drawn with regard to counterfeit protection.

The sensor unit can be fixed in the core of the club head so that it cannot be removed from the club head without destruction. However, it is also conceivable that the sensor unit can be removed from the club head without being destroyed. For example, the sensor unit could be removed non-destructively in a modular construction of the club head, which was assembled by connection techniques such as screwing or plugging together. In the case of a modular construction of the club head or the club, it would also be possible to exchange the individual modules.

The club head may additionally comprise an energy supply unit for supplying the sensor unit with energy, wherein the energy supply unit may be arranged in the club head, preferably in the core, in a fixed or removable manner. For example, the energy supply unit may be a battery which is permanently arranged in the club head and cannot be removed. Or, for example, it may be a battery that can be removed from the club head and recharged or replaced with a new battery. Such an energy supply to the sensor unit can be referred to as actively operating the sensor unit. It is also conceivable here to arrange the energy supply unit not in the club head but at another location in the golf club, for example in the shaft. It is also conceivable that a self-sufficient energy supply of the sensor unit takes place, for example by the swing mass in an induction system inducing an induction voltage through the movement of the club head or the golf club, which can be made available to the sensor unit as an energy supply.

However, it is also conceivable to operate the sensor unit passively, i.e. to supply the sensor unit with an energy supply unit that is located outside the club head. Thus, at least one of the sensors, for example an RFID transponder, could be supplied with energy from the signals of an analysis or reading device. Preferably, a coil as a receiving antenna could be used to charge a capacitor by induction, similar to a transformer.

As already mentioned, the sensor unit often has its own weight, which can have a negative effect on the impact dynamics or lead to undesirable changes in the swinging behaviour. The at least one weighting element can, among other things, serve in particular to compensate for any change in the swinging behaviour due to the sensor unit. The weighting element or elements are preferably designed and arranged in the club head in such a way that they compensate for the influence of the sensor unit on the impact dynamics. Conversely, it is also conceivable that the sensor unit itself forms a weighting element which is designed and arranged in such a way that the impact behaviour of the club head is specifically improved.

The weighting element is preferably immovably arranged in or on the club head. However, the club head can additionally have a cavity, whereby the weighting element is displaceably arranged in the cavity.

Due to a displaceably arranged weighting element, kinetic energy is stored in this displaceable weighting element during impact, which is released again when the club head meets the ball and the club thus decelerates during the free movement of this weighting element in the direction of impact, in addition to the impact energy transferred from the club head to the ball, in other words, it can be said that the force acting on the club as a "backstroke impulse" is compensated when hitting the ball and an additional force of the order of magnitude of the backstroke contributes to the acceleration of the ball, whereby in particular high hitting distances can be achieved.

The weighting element can be arranged completely or at least partially, in particular to a major part, within the shell. Preferably, the weighting element is arranged completely or at least partially, in particular to a major part, inside the core. Preferably, the weighting element is arranged in the area of an underside of the club head.

The weighting element can be designed according to a desired weight distribution, for example semicircular or annular, and be arranged in the area of the underside or centrally in the club head.

According to a particularly preferred embodiment, a first weighting element and a second weighting element are provided, which are each arranged laterally to the striking plate, in this case, the striking plate is advantageously arranged between the first and the second weighting element. Advantageously, the two weighting elements are each attached to the outside of the shell in this embodiment. This not only has the advantage that the weight distribution is optimal with regard to the impact behaviour, but also that the weighting elements can be mounted particularly easily and, for example, replaced by others.

The weighting element can toe arranged only in the shell or only in the core or both in the shell and in the core. As already mentioned, the lower density of the second material of the core compared to the higher density of the first material of the shell, in particular when the club head hits the ball, causes a bounce or swinging (or recoil) damping, which has a corresponding effect on a weighting element. I.e., while a weighting element on the one hand leads to an additional force at impact and correspondingly also to an additional "swinging impulse", the different densities of the shell or core material enable damping in the sense of cushioning. The effect of such a backstroke impulse on a possibly existing sensor unit and on the golfer can thus be reduced or even prevented, so that despite the additional backstroke force of the weighting element, precise detection and/or analysis of the club movement as well as ergonomic handling are still possible.

Analogous to the arrangement of a weighting element according to the type described above, a cavity may be arranged in the shell and/or in the core, preferably in the region of an underside of the club head, and the weighting element may thereby be present therein composed of a plurality of components, the plurality of components preferably being a powder or a pellet mixture. However, it is also conceivable that the weighting element is present as a liquid in the cavity, or that the weighting element is an integrally formed solid weighting element which is movably arranged in the cavity. In other words, a cavity may be formed in the club head which is filled with a solid mass, e.g. a foam material, or which is filled with a movable mass, e.g. powder, pellets or a liquid.

The third material of the weighting element may be a metal or an alloy, especially if the weighting element is formed in one piece. The metal may be, for example, lead or tungsten A weighting element in the form of a powder or pellet mixture may have a high density component, for example tungsten, and may have a compound component, for example copper or tin. A variety of suitable materials for such weighting elements are known to the skilled person. The weighting element arranged in a cavity, such as a powder, a pellet mixture or a liquid, initially slides from the club head towards the shaft during the outswing movement within the cavity, and then slides back into the club head when swinging through. This results in a higher club head speed of the swing and enables a high directional accuracy as well as long hitting distances.

For individual adjustment of the swing weights of the golf club, it is possible for the weighting element to be removable from the club head in a non-destructive manner. This enables an individual adaptation of the club to the golfer, whereby the weighting element can be selected according to requirements in such a way that a large moment of inertia is created, while at the same time there is a desired dynamic response at impact.

In general, it is to be understood here that one or more weighting elements may be disposed inside the shell and/or inside the core and/or that one or more weighting elements may be disposed in one or more cavities inside the shell and/or inside the core.

For example, if a weighting element is arranged only inside the core, the shell immediately adjacent to the core may completely enclose the core. For example, if a weighting element is arranged inside the core and inside the shell, the shell only partially encloses the core immediately adjacent thereto, namely in those areas where there is no weighting element between the core and the shell.

Furthermore, a golf club is provided which has a club head as indicated above. The golf club may comprise a shaft, a grip, and a connector piece, the shaft being attachable to the club head via the connector piece.

BRIEF DESCRIPTION OF THE DRAWINGS

Preferred embodiments of the invention are described below with reference to the drawings, which are for explanatory purposes only and are not to be interpreted restrictively. In the figures are shown.

DESCRIPTION OF PREFERRED EMBODIMENTS

Figure 1:
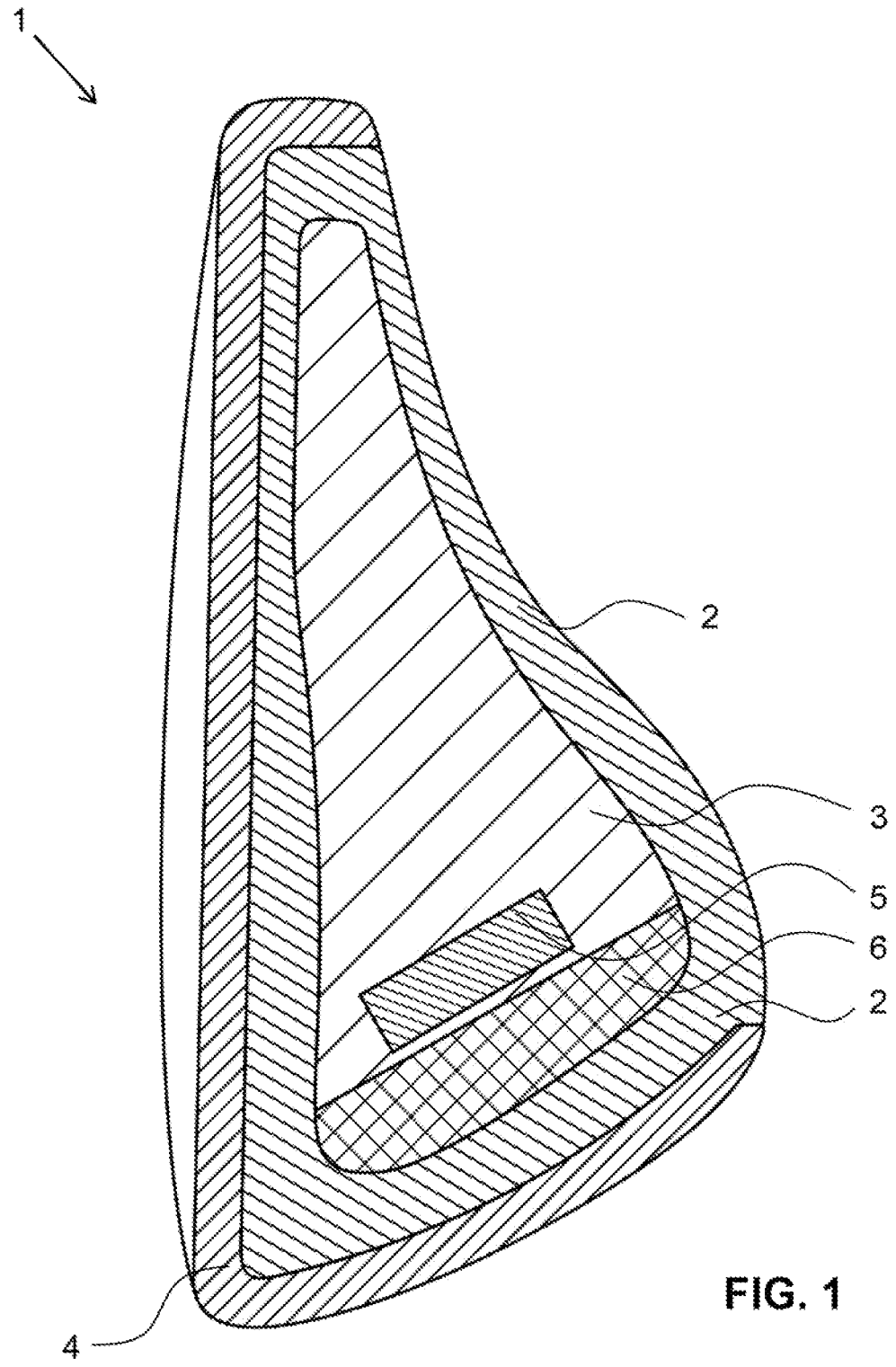
FIG. 1 a cross-section through a club head according to a first embodiment.

FIGS. 1 to 11 each show a club head 1 for a golf club, which has a shell 2 of a first material and a core 3 of a second material completely or at least partially surrounded by the shell 2. A striking plate 4 for hitting a golf ball is attached to the outside of the shell 2 in each case. A sensor unit 5 is arranged inside the core 3, the core completely or at least partially enclosing the sensor unit 5. In each case, the core 3 occupies a larger volume of the club head 1 than the shell 2. At least one weighting element 6 or 6*a*, 6*b* made of a third material is arranged in or on the club head in each case, different designs and arrangements of the weighting element (s) being possible according to FIGS. 1 to 11. Identically or similarly designed elements with the same or similar function are each provided with the same reference signs in FIGS. 1 to 11.

FIG. 1 shows a first embodiment of the club head 1, in which the sensor unit 5 and the weighting element 6 are each arranged centrally in the region of an underside of the club head 1. The sensor unit 5 is completely enclosed by the core 3 and is located in the area of its underside directly next to the weighting element 6, which is immovably arranged between the shell 2 and the core 3. The weighting, element 6 is designed and arranged in such a way that optimum impact behaviour is achieved. In this case, the weighting element 6 is essentially rectangular and extends along an entire width of the core 3.

Figure 2:
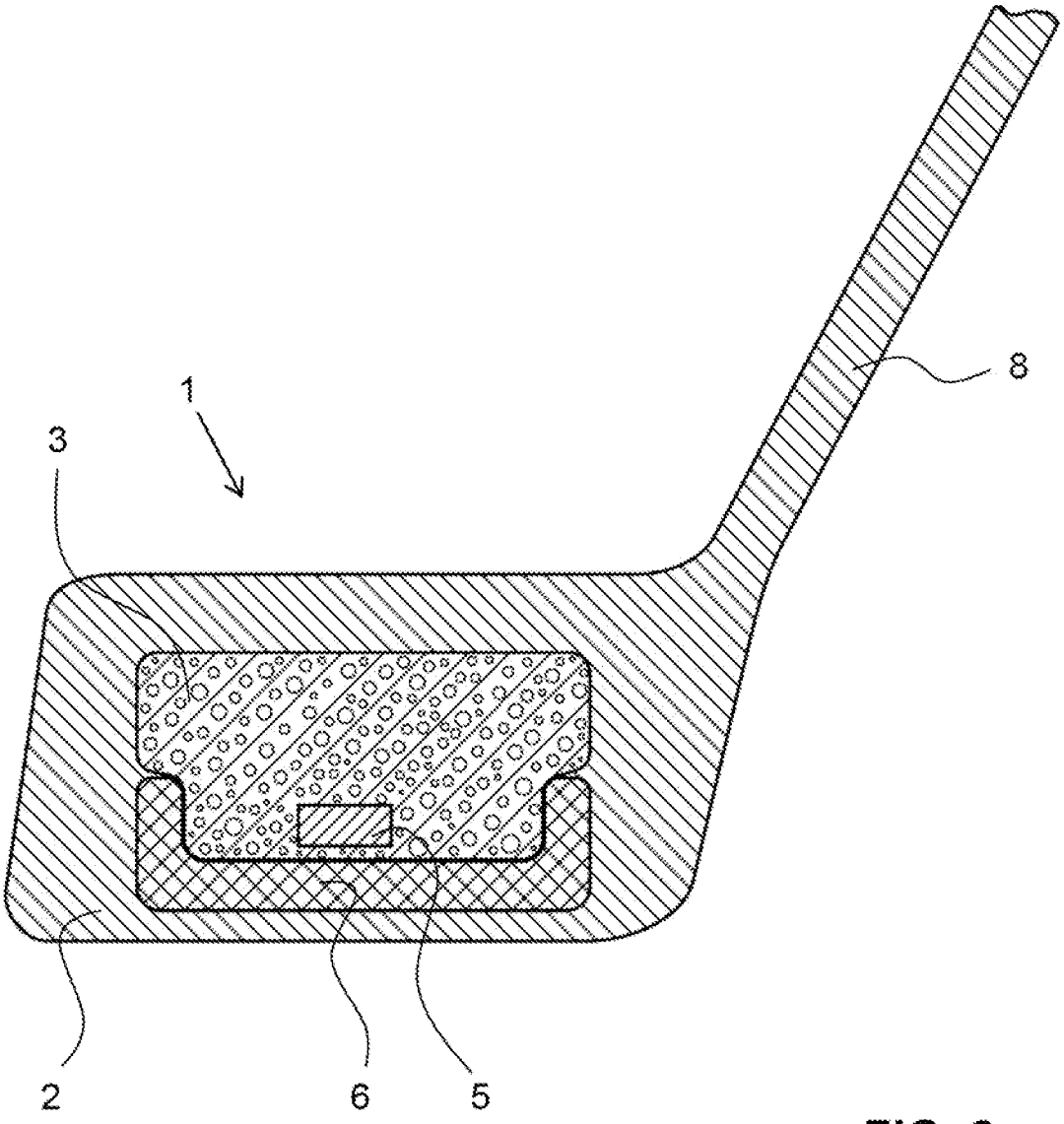
FIG. 2 a longitudinal section through a golf club with a club head according to a second embodiment.

In the second embodiment of the club head 1 shown in FIG. 2, the sensor unit 5 is again located centrally in the area of an underside of the club head 1 and is completely enclosed by the core 3. The core 3 is T-shaped and the weighting element 6 is U-shaped and extends along the entire width as well as over a partial area of the height of the core 3, so that the core is partially received in or enclosed by the channel formed by the U-shaped design of the weighting element 6. Both the core 3 and the weighting element 6 are completely enclosed by the shell 2.

Figure 3:
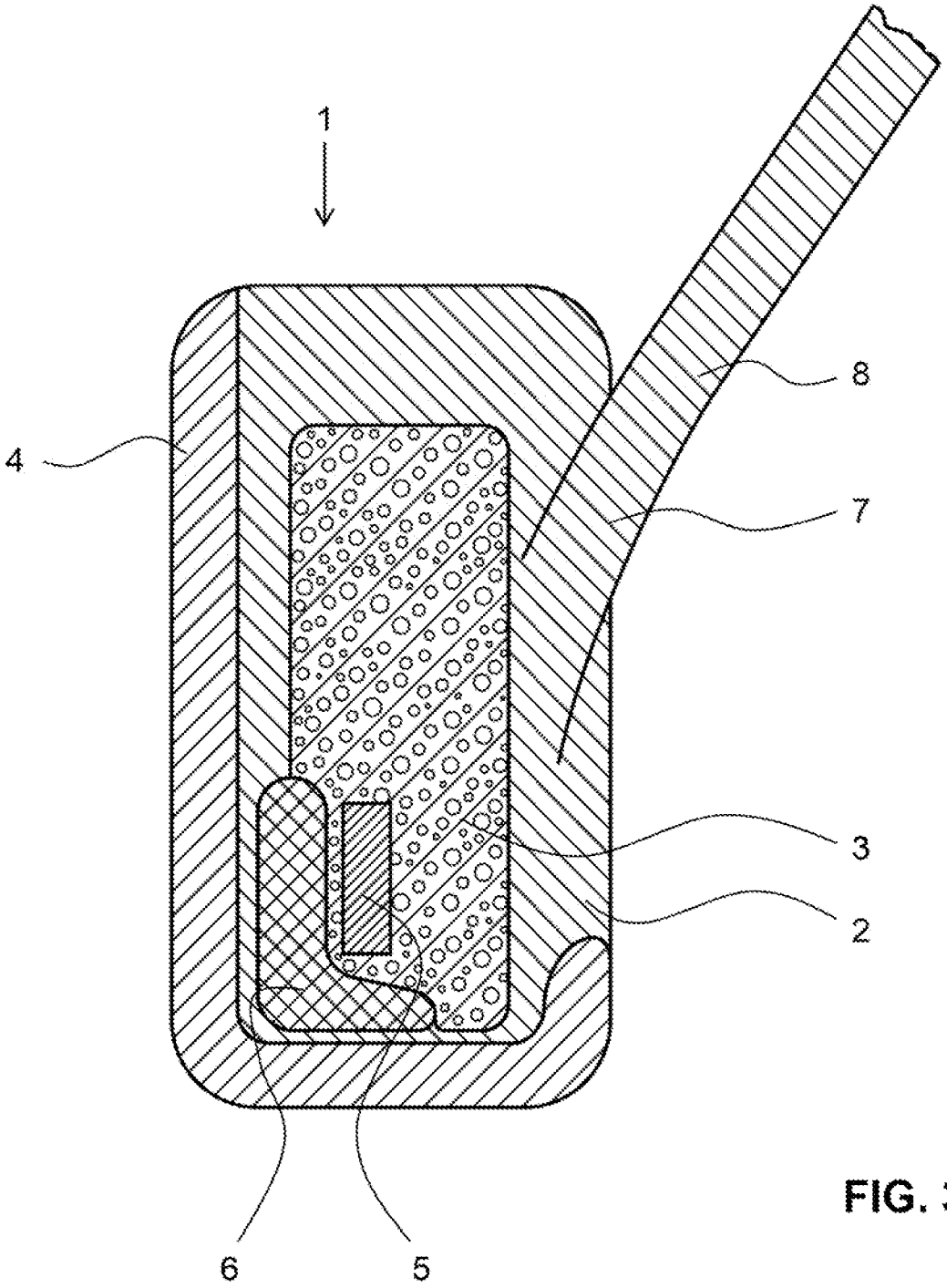
FIG. 3 a cross-section through a golf club with a club head according to a third embodiment.

In the third embodiment of the club head 1 shown in FIG. 3, the sensor unit 5 and the weighting element 6 are arranged on one side in the club head. The weighting element extends in an L-shape over a partial area of the height of the shell 2 and the core 3 in the area of the front of the club head and projects in this partial area into the shell 2 and the core 3. The sensor unit 5 is completely enclosed by the core 3 and is located close to the weighting element 6. The weighting element 6 has an L-shaped profile with two legs at right angles to each other, which together span an area in which the sensor unit 5 is arranged. This arrangement allows the sensor unit 5 to be additionally protected from forces acting on the club head 1. The striking plate 4 is attached to the front of the club head 1 and also has an L-shaped profile which extends along the entire underside and on one side along the entire height of the club head 1.

Figure 4:
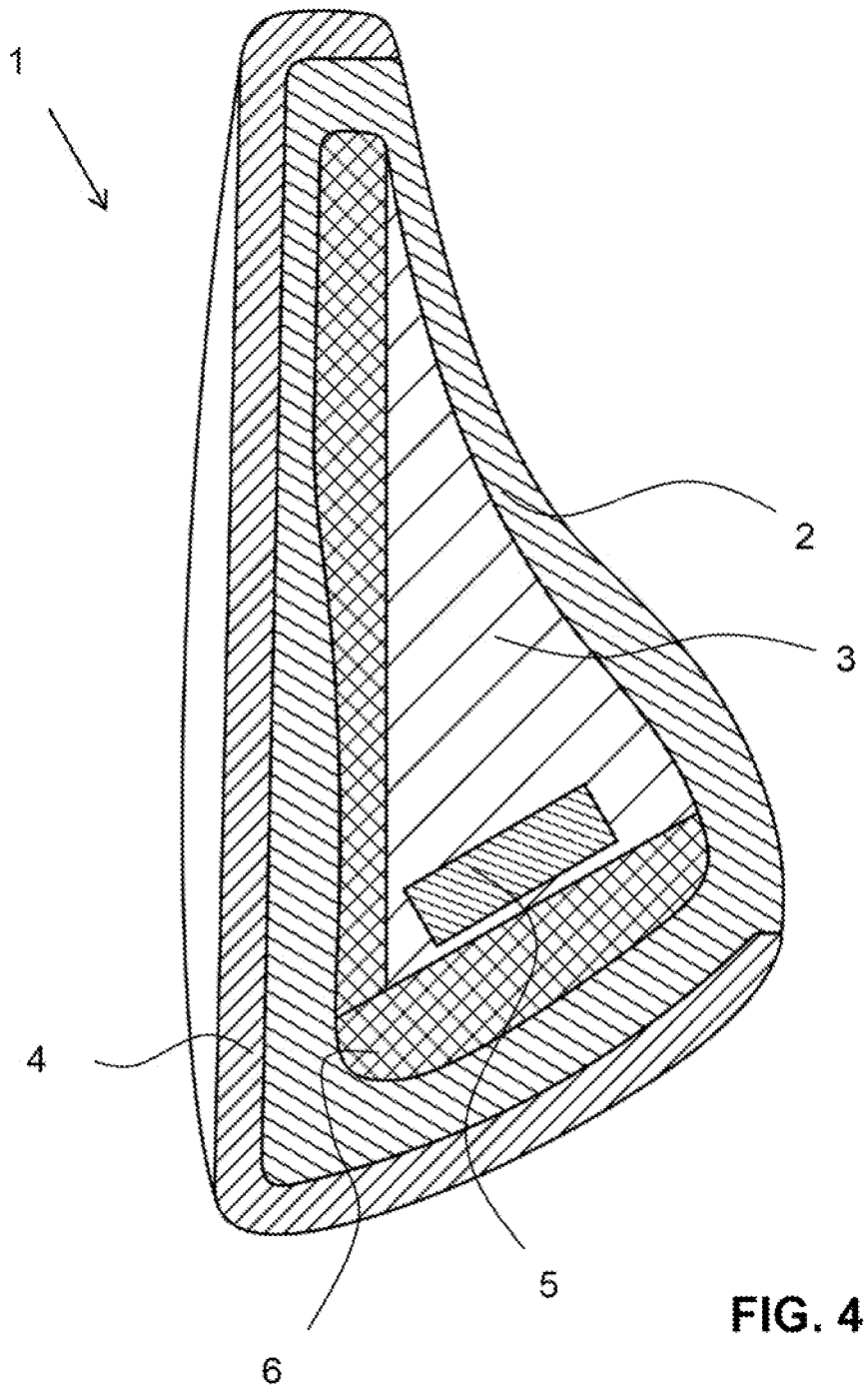
FIG. 4 a cross-section through a golf club with a club head according to a fourth embodiment.

FIG. 4 shows a club head 1 for a golf club in which a substantially L-shaped weighting element 6 extends along an underside of the core 3 and along the entire height of the striking plate 4 between the shell 2 and the core 3. The sensor unit 5 is arranged centrally in the area of the underside of the club head 1 and is completely enclosed by the core 3.

Figure 5:
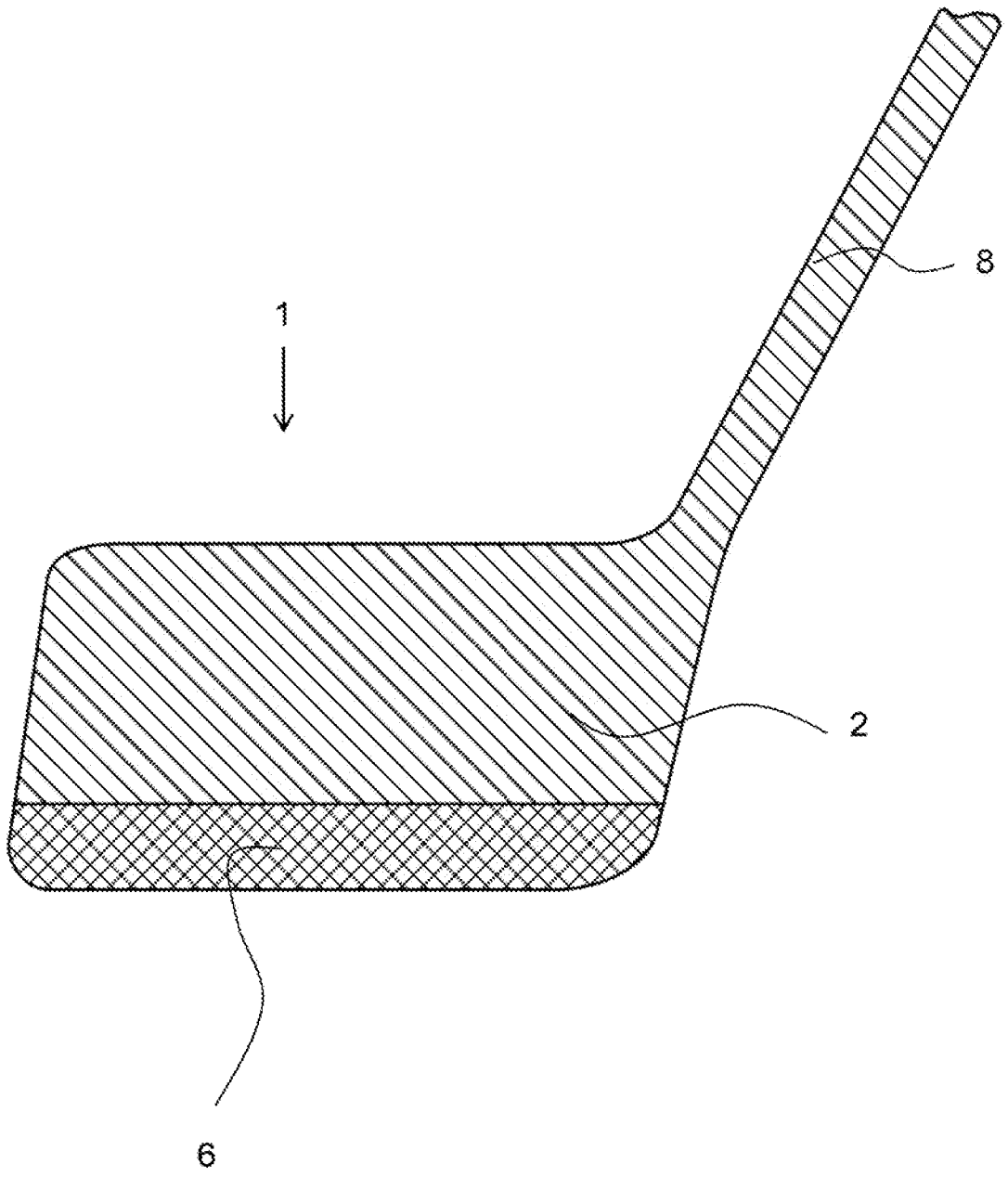
FIG. 5 a longitudinal section through a golf club with a club head according to a fifth embodiment.
Figure 6:
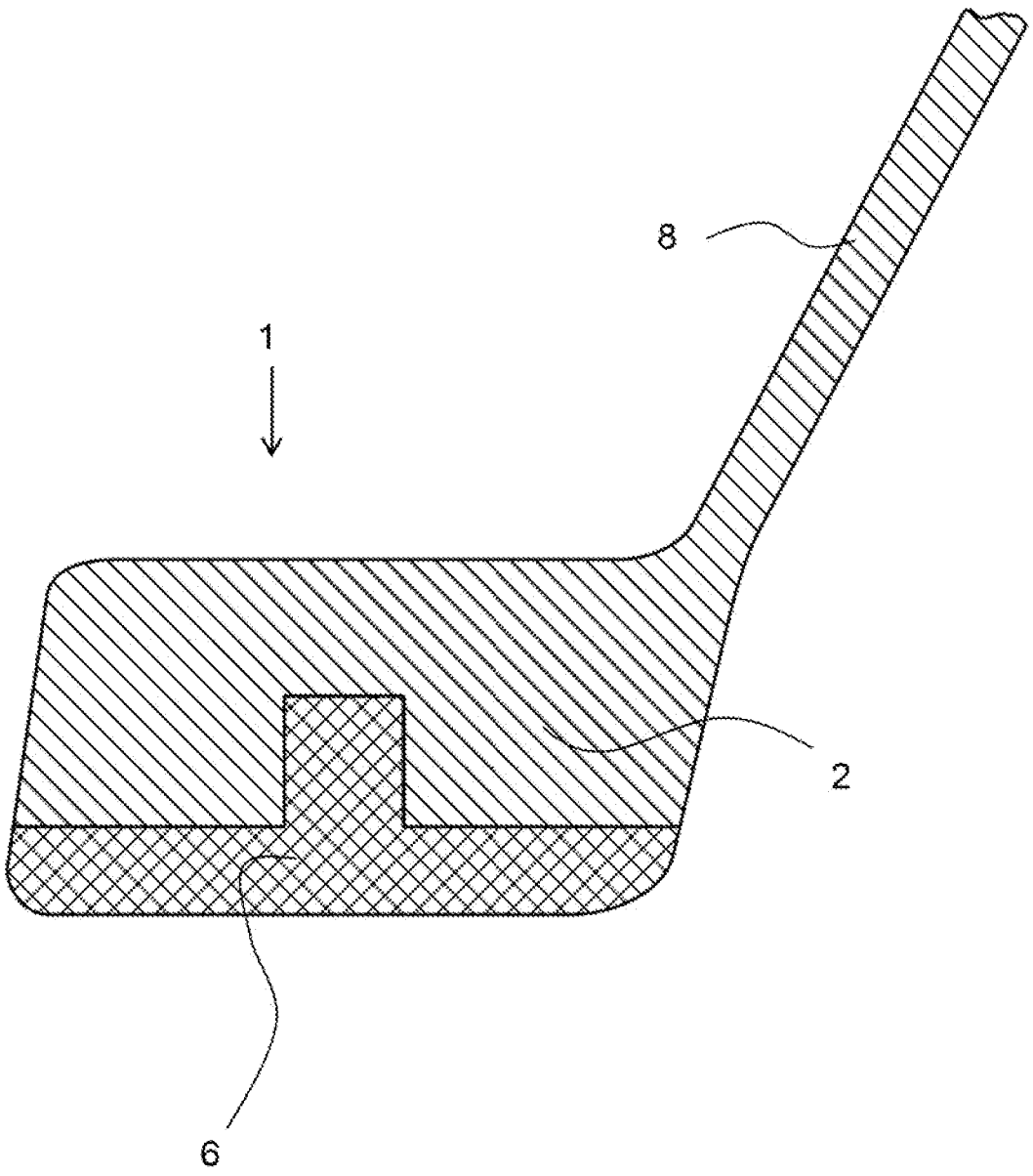
FIG. 6 a longitudinal section through a golf club with a club head according to a sixth embodiment.

FIGS. 5 and 6 each show a club head 1 with a weighting element 6. In these figures, neither the shell nor the sensor unit of the club head 1 is visible in each case. However, as in the embodiments of FIGS. 1 to 4, a shell is provided in each case which at least partially surrounds a core, and a sensor unit is provided in each case as in the embodiments of FIGS. 1 to 4, which is arranged at least partially in the inside of the core. In contrast to the club heads 1 of FIGS. 1 to 4, the flat weighting element 6 in the club heads 1 of FIGS. 5 and 6 is not arranged in the inside of the shell 2 in each case, but is attached to its underside.

The weighting element 6 of the embodiment shown in FIG. 5 is formed as an overall flat plate. The weighting element 6 of FIG. 6 is also flat on a side facing away from the shell 2 and has a projection on a side facing the shell 2, which extends into the shell 2. The flat side of the weighting element 6 extends parallel to the outside of the shell 2. The weighting element 6 shown in FIG. 6 is thus substantially T-shaped, the free central leg of the T-shaped weighting element 6 being received in a recess in the shell 2, which is substantially U-shaped in longitudinal section.

Figure 7:
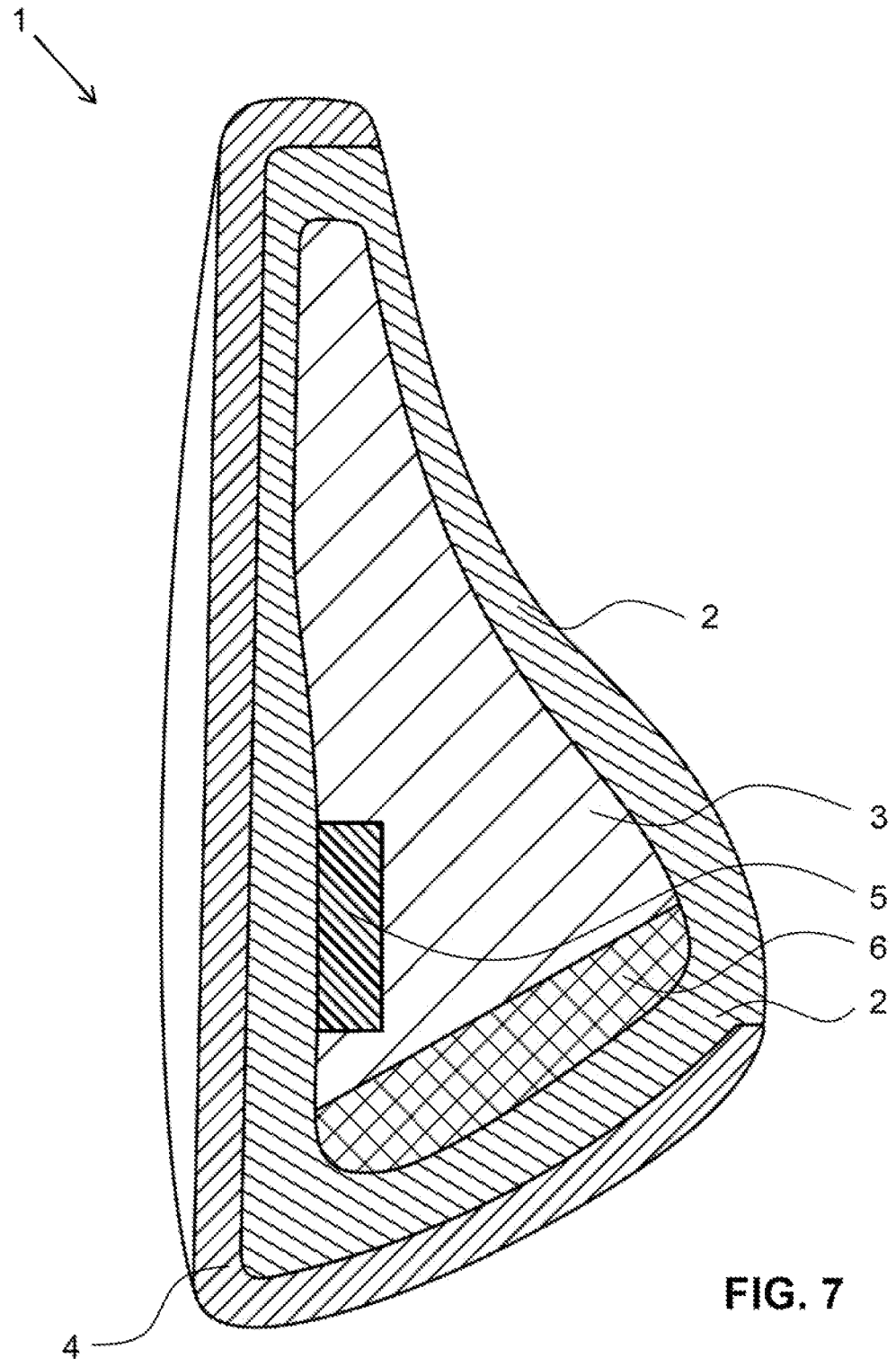
FIG. 7 a cross-section through a golf club with a club head according to a seventh embodiment.
Figure 8:
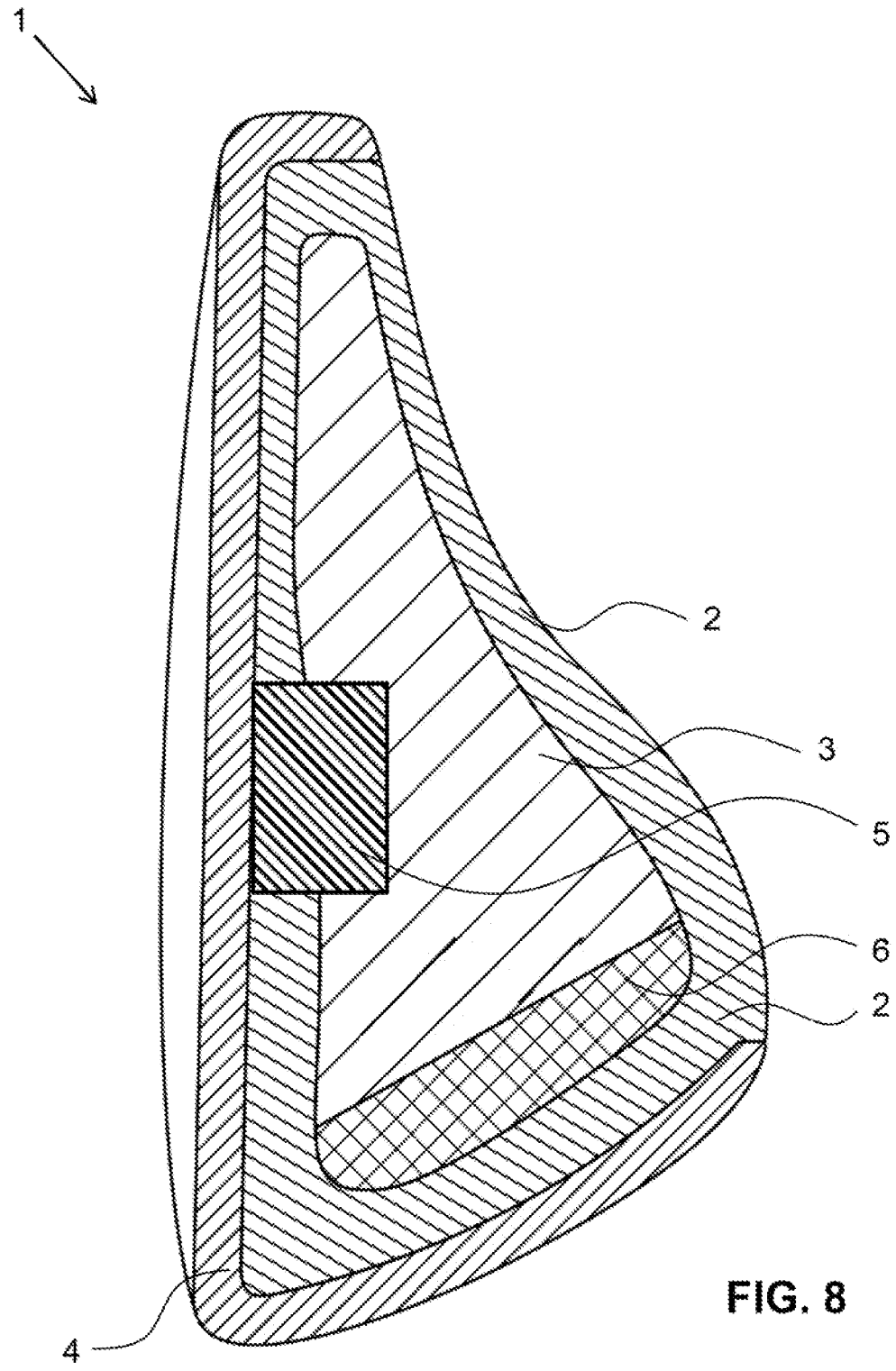
FIG. 8 a cross-section through a golf club with a club head according to an eighth embodiment.

The embodiments shown in FIGS. 7 and 8 differ from that of FIG. 1 in that the sensor unit 5 is not completely, but only partially, arranged in the inside of the core 3. In these embodiments, however, a major part of the sensor unit 5 is still arranged in the inside of the core 3, i.e. a major part of the sensor unit 5 is enclosed by the core 3.

In the embodiment shown in FIG. 7, the front of the sensor unit 5 lies against the inner surface of the shell 2 in the area of the striking plate 4, but is otherwise enclosed by the core 3. The sensor unit 5 is thus completely enclosed by the shell 2, but only partially enclosed by the core 3.

In the version according to FIG. 8, the front side of the sensor unit 5, which is usually formed by a signal transmitter, is in contact with the inner surface of the striking plate 4, but is also at least partially enclosed by the core 3. In contrast to the embodiment according to FIG. 7, however, the sensor unit 5 in the present embodiment is not completely enclosed by the shell 2, but penetrates through the shell 2 with its area facing the striking plate 4. Thus, the sensor unit 5 is also only partially enclosed by the core 3, although a predominant part of the volume of the sensor unit 5 is nevertheless located in the core 3.

Figure 9:
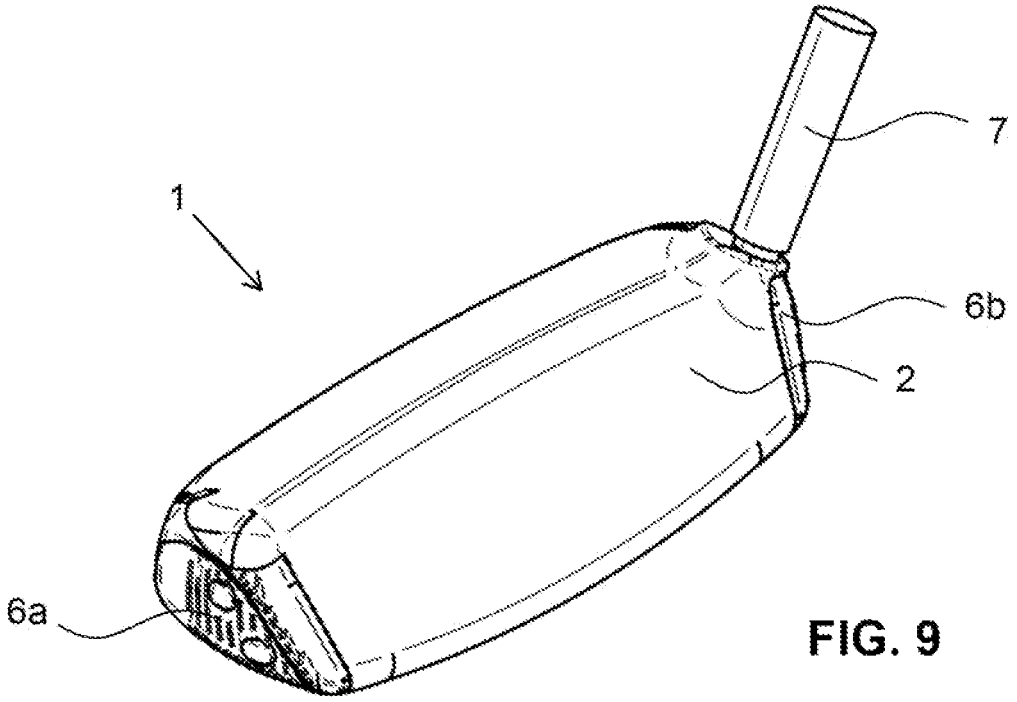
FIG. 9 a perspective view of a club head according to a ninth embodiment, without striking plate.
Figure 10:
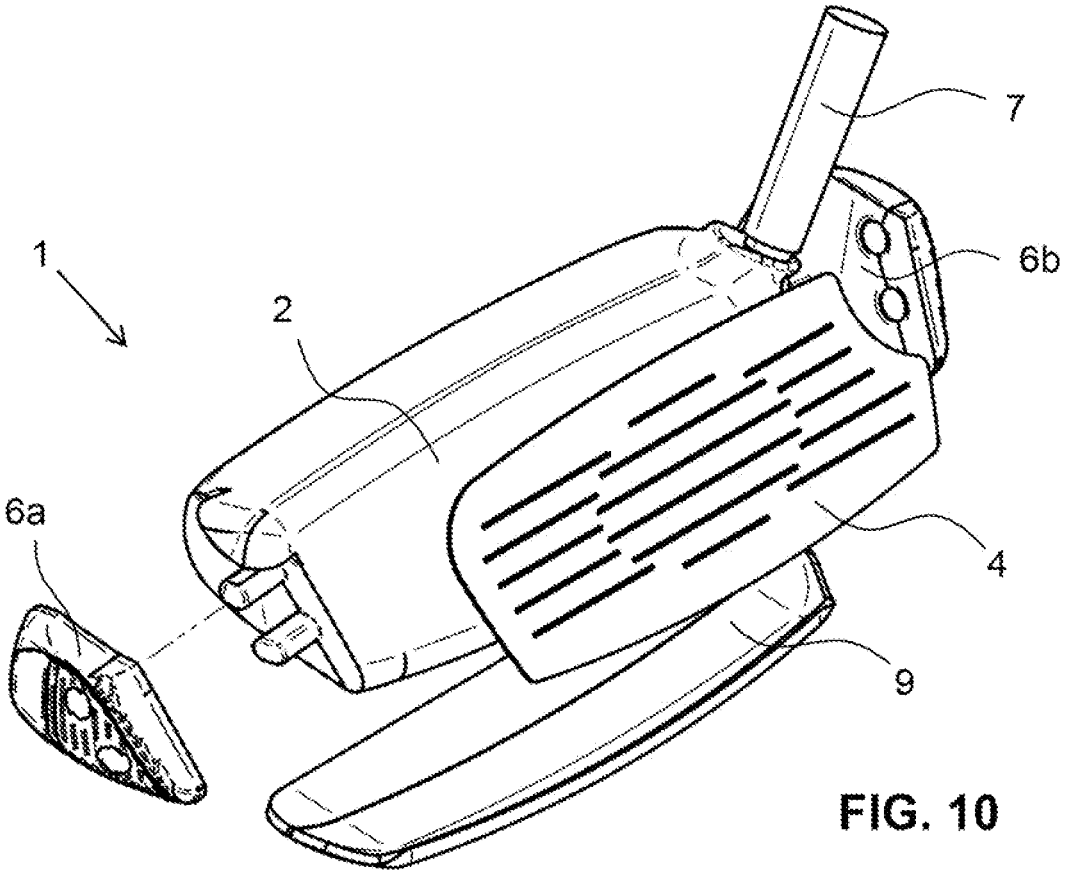
FIG. 10 a perspective exploded view of the club head of FIG. 9, with striking plate.
Figure 11:
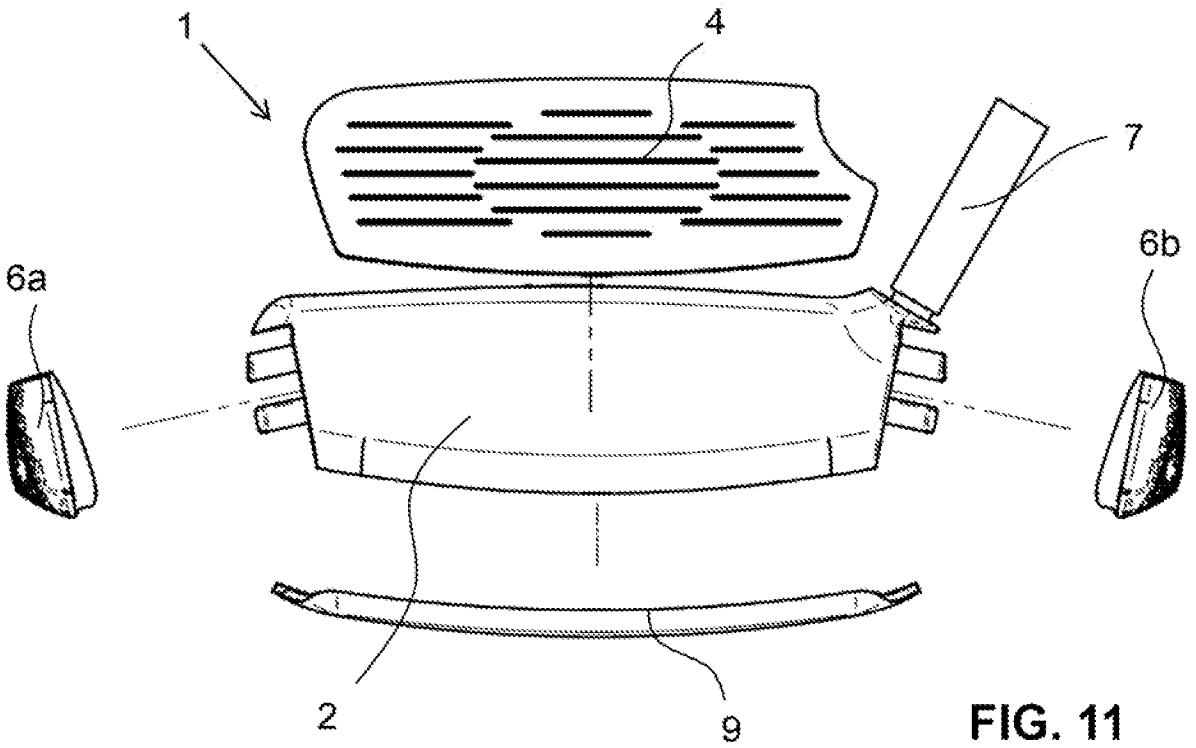
FIG. 11 an exploded view from the front of the club head of FIG. 9, with striking plate.

FIGS. 9 to 11 show a further embodiment of a club head 1 according to the invention, Here, too, a shell 2 completely encloses a core which is not visible in FIGS. 9 to 11. The core is preferably formed by a foam material or a gaseous material, such as air in particular. In the latter case, the shell 2 thus encloses a cavity and the air filling this cavity forms the core. The material of the core preferably occupies a larger volume than the material of the shell 2.

The embodiment shown in FIGS. 9 to 11 preferably, but not necessarily, comprises a sensor unit 5, which can be arranged, for example, in the form of a sensor plate between the shell 2 and on a striking plate 4, which is attached to the front of the shell 2. Particularly preferably, however, the sensor unit 5 is arranged at least partially, in particular completely, in the inside of the core. For example, it may be attached to an inner surface of the shell 2, in particular to the inner surface of the front side of the shell 2, or, in particular if the core is made of a foam material, it may be arranged completely inside the core.

In the present exemplary embodiment, the club head 1 comprises two weighting elements 6*a* and 6*b*, which are attached to the shell 2 laterally to the striking plate 4 on the outside. For holding the weighting elements 6*a* and 6*b*, outwardly projecting pins are integrally formed on the shell 2, which are inserted into correspondingly provided openings when attaching the weighting elements 6*a*, 6*b*. Alternatively or additionally, the weighting elements 6*a*, 6*b* can also be glued and/or screwed to the shell 2. The combination of the weighting elements 6*a*, 6*b* arranged to the outside laterally of the striking plate 4 with a core made of a foam material or a gaseous material has proven to be particularly advantageous with regard to the hitting behaviour of the golf club.

In contrast to the previous embodiments, the striking plate 4 does not have an L-shaped profile here, but a flat profile overall. Instead, a sole plate 9 made of metal is attached to the shell 2 to reinforce the underside of the club head 1.

As shown in FIGS. 2 and 3 and FIGS. 5 and 6, the club head 1 is connected to a shaft 8. In this respect, the club head 1 of FIGS. 2, 5 and 6 is formed integrally with the shaft 8, whereas the club head 1 of FIGS. 3 and 9 to 11 is attached to the shaft 8 via a hosel 7.

Even though in all embodiments shown in FIGS. 1 to 11 a sensor unit 5 is present in the club head, it is perfectly conceivable to provide these club heads without the sensor unit. Even then, the club heads still have particularly good impact behaviour.

The invention claimed is:

1. A club head for a golf club, comprising:

a striking plate for striking a golf ball, a shell made of a composite material and having an outside to which the striking plate is attached directly, such that the shell is partially surrounded by the striking plate, a core made of a foam material or a gaseous material at least partially surrounded by the shell, and a first weighting element and a second weighting element, each made of a further material, wherein the foam material or a gaseous material of the core has a lower density than the composite material of the shell, wherein the further material of the first weighting element and of the second weighting element has a higher density than the composite material of the shell and/or than the foam material or the gaseous material of the core, wherein the shell completely encloses the core, and wherein the first weighting element and the second weighting element are each arranged completely within the shell and laterally to the striking plate.

2. The club head according to claim 1, wherein the club head additionally comprises at least one sensor unit which is at least partially arranged in the inside of the core.

3. The club head according to claim 2, wherein the core completely encloses the sensor unit.

4. The club head according to claim 2, wherein the sensor unit comprises at least one sensor for detecting the impact dynamics.

5. The club head according to claim 4, wherein the at least one sensor for detecting the impact dynamics is an angular velocity sensor and/or an acceleration sensor and/or a magnetic sensor.

6. The club head according to claim 2, wherein the sensor unit comprises at least one sensor for ensuring anti-counterfeiting.

7. The club head according to claim 6, wherein the at least one sensor for ensuring anti-counterfeiting is designed as an RFID transponder suitable for transmitting and/or receiving RF signals.

8. The club head according to claim 2, wherein the sensor unit is removable from the club head.

9. The club head according to claim 2, additionally comprising an energy supply unit for supplying the sensor unit with energy, wherein the energy supply unit is arranged in the club head.

10. The club head according to claim 9, wherein the energy supply unit is arranged in the core.

11. The club head according to claim 1, wherein the core occupies a larger volume of the club head than the shell.

12. The club head according to claim 1, wherein the first weighting element and the second weighting element are immovably arranged in the club head.

13. The club head according to claim 1, wherein the first weighting element and the second weighting element are arranged inside the core.

14. A golf club comprising a club head with:

a striking plate for striking a golf ball, a shell made of a composite material and having an outside to which the striking plate is attached directly, such that the shell is partially surrounded by the striking plate, a core made of a foam material or a gaseous material at least partially surrounded by the shell, and a first weighting element and a second weighting element, each made of a further material, wherein the foam material or gaseous material of the core has a lower density than the composite material of the shell, wherein the further material of the first weighting element and of the second weighting element has a higher density than the composite material of the shell and/or than the foam material or the gaseous material of the core, wherein the shell completely encloses the core, and wherein the first weighting element and the second weighting element are each arranged completely within the shell and laterally to the striking plate.

* * * * *